US005632481A

United States Patent [19]

Unger et al.

[11] Patent Number: 5,632,481

[45] Date of Patent: May 27, 1997

[54] BLADE FOR AN INDOOR BANDY STICK

[75] Inventors: Michael Unger, Mäntyharju, Finland; Jyri Uimonen, Götzi, Austria

[73] Assignee: Exel Oy, Finland

[21] Appl. No.: 532,093

[22] Filed: Sep. 22, 1995

[51] Int. Cl.[6] ..... A63B 59/14

[52] U.S. Cl. ..... 473/563

[58] Field of Search ..... 273/67 A, 67 R, 273/1.8

[56] References Cited

U.S. PATENT DOCUMENTS

| | | | |
|---|---|---|---|
| D. 244,790 | 6/1977 | Carlson | 273/67 A |
| 3,489,412 | 1/1970 | Franck et al. | 273/67 A |
| 3,720,410 | 3/1973 | Saytar | 273/67 A |
| 4,076,240 | 2/1978 | Haddad | 273/67 A |
| 5,429,352 | 7/1995 | Leclerc | 273/67 A |

FOREIGN PATENT DOCUMENTS

| | | | |
|---|---|---|---|
| 1188601 | 4/1970 | United Kingdom | 273/67 A |

*Primary Examiner*—Mark S. Graham

*Attorney, Agent, or Firm*—Price, Heneveld, Cooper, DeWitt & Litton

[57] ABSTRACT

The invention relates to a blade for an indoor bandy stick, comprising a top-edge reinforcing rib (5), a bottom-edge reinforcing rib (6) and therebetween a number of reinforcing ribs (7, 9) which lie lengthwise of the blade and are spaced from each other so as to form open spaces between the lengthwise ribs (5, 6, 7, 9). The interspace between the mid-section reinforcing ribs (7) is located at the distance of a radius (D/2) of a ball (3) from the bottom edge of a blade (12). Thus, the ball hits the reinforcing ribs at more than one point along the ball surface. One or both sides of the blade can be concave.

7 Claims, 2 Drawing Sheets

BLADE FOR AN INDOOR BANDY STICK

The present invention relates to a blade for an indoor bandy stick, comprising a top-edge reinforcing rib, a bottom-edge reinforcing rib and therebetween a number of reinforcing ribs which lie lengthwise of the blade and are spaced from each other so as to form open spaces between the reinforcing ribs, the lengthwise ribs being braced by means of crosswise ribs extending transversely and/or diagonally relative thereto.

BACKGROUND OF THE INVENTION

In the blades pr prior known indoor bandy sticks, the position of reinforcing ribs is such that there is no satisfactory contact between blade and ball. After all, the ribbing is designed primarily in view of the structural qualities and appearance of a blade. A relatively close or dense ribbing, in which, furthermore, the distance of a centre rib from the bottom edge of a blade is typically equal to the ball radius, creates one loading point at the contact point between ball and blade. FIG. 1 illlustrates how a thin-walled plastic ball bounces as a result of such contact so that the ball buckles inwards at the point of loading. This results in a loss of energy, which reduces the ball take-off speed.

Finnish utility model 1279 discloses an indoor bandy stick, including a blade in the form of a frame which defines a continuous large opening in the middle. When advancing forward, the ball is indeed firmly held by the grip of the blade. On the other hand, when struck by the blade, the ball often bounces uncontrollably in unpredictable directions since the ball and the blade should always meet each other at a certain level in order to achieve a double contact with the blade frame. In practice, it is often the case that the ball or the blade is off the floor and do not come together at the required level. Another problem is how to produce a sufficiently strong blade with a structure in the form of a mere frame or rim. For the above reasons, the invention is based on a blade structure including both lengthwise and crosswise reinforcing ribs.

SUMMARY OF THE INVENTION

An object of the invention is to provide a blade for an indoor bandy stick, wherein the arrangement of reinforcing ribs is improved so as to achieve an improved transfer of energy from blade to ball and thus an increased take-off speed for the ball.

A second object of the invention is to shape one or both of the side faces of the blade to such a curvature that the ball is more firmly retained by the grip such a curved-surface blade when carrying the ball forward and at the same time the ball take-off direction is more accurately focused.

These objects are achieved by the invention on the basis of the characterizing features set forth in the annexed claims such that the scope of protection is defined on the basis of the independent claim 1 while the non-independent claims disclose preferred embodiments for the invention.

BRIEF DESCRIPTION OF THE FIGURES

The invention will now be described in more detail with reference made to the accompanying drawings, in which.

DETAILED DESCRIPTION OF THE PREFERRED EMBODIMENTS

Figure 1:
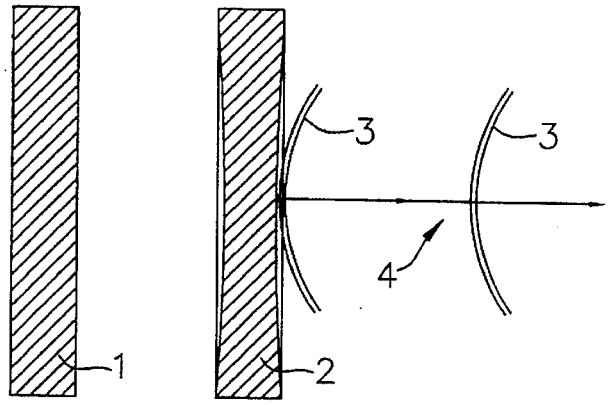
FIG. 1 illustrates the ball behaviour as it bounces from conventional blade.

Referring to FIG. 1, reference numeral 1 designates a conventional flat blade in cross-section and reference numeral 2 shows a cross section for a blade wit both sides slightly concave. The ball touches such blades at a single point of loading whereby, during the ball acceleration, the thin-walled ball buckles at the point of loading, resulting in a loss of energy and deceleration of take-off speed.

Figure 2:
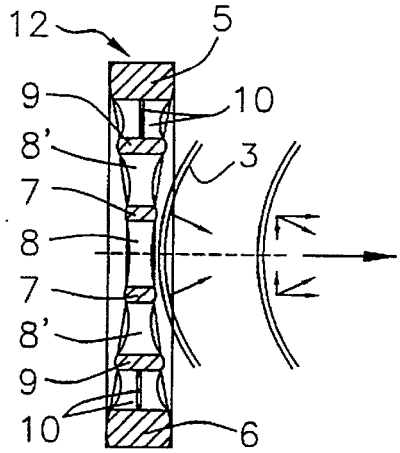
FIG. 2 shows a cross-section for a blade of the invention and the ball behaviour as it bounces from a blade of the invention.
Figure 3:
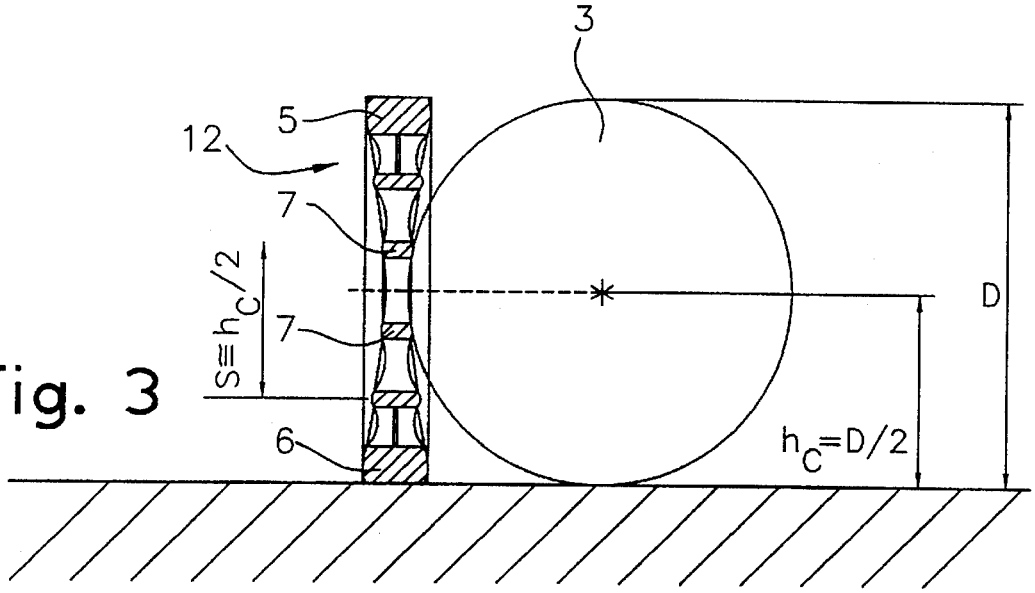
FIG. 3 shows a cross-section for a blade of the invention and its dimensions in relation to a standard ball.

According to FIGS. 2 and 3, the above problem is eliminated by placing central lengthwise ribs 7 in such a position that an open interspace between the ribs 7 is located at the distance of a radius D/2 of a ball 3 from the bottom edge of a blade 12. In the present case, the horizontal reinforcing ribs 7, 9 lie symmetrically on either side of the longitudinal centre line of the blade with the longitudinal central area of the blade left open. A distance S between the reinforcing ribs 7 defining this open interspace at the accuracy of about 20% is equal to the half of the radius D/2 of the ball 3. In most cases, this arrangement of reinforcing ribs provides more than one area of contact between blade and ball. FIG. 2 illustrates how the central-area pair of ribs 7 focuses the forces on the ball. The distribution of forces and the opposing components thereof prevent effectively the buckling of the thin wall of a ball for an improved transfer of energy and a higher take-off speed.

The horizontal reinforcing ribs 7, 9, 5, 6 are tied to each other by means of vertical or diagonal reinforcing ribs 8, 8', 10, which lie at suitable distances in the longitudinal direction of a blade and are thinned over the central areas thereof in such a manner that the points of loading between ball and blade develop principally on the side faces of the horizontal reinforcing ribs.

The blade 2 has a height which is essentially equal to a standard ball diameter D. Thus, it is preferred that between the top- and bottom edge reinforcing ribs 5 and 6 be provided four horizontal reinforcing ribs 7, 9, the distance therebetween in the vertical direction of a blade being approximately a half of the ball radius D/2. Particularly, the ribs 7 included in the middlemost pair of ribs have a distance $S=h_c/2$, when $h_c=D/2$.

In the case of FIGS. 2 and 3, both side faces of the blade are concave, which is due to the fact that the mid-section ribs 7 of the blade have a lateral thickness which is approximately a half of the thickness of the top- and bottom-edge reinforcing ribs 5 and the ribs 9 have a thickness which is halfway between the above-mentioned thicknesses.

Figure 4:
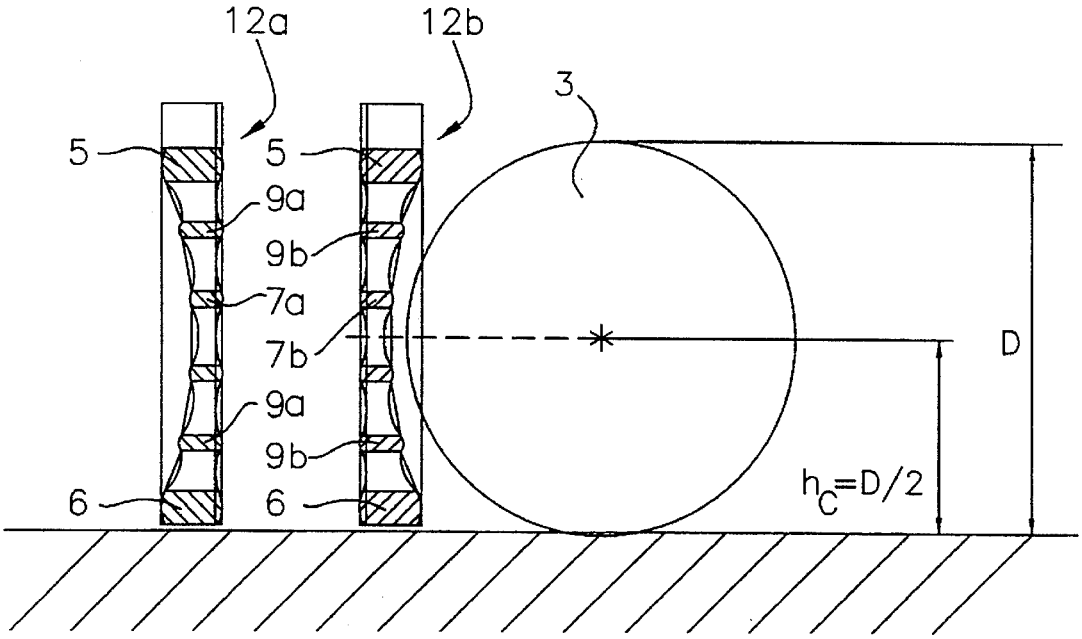
FIG. 4 shows cross-sections for blades according to alternative embodiments of the invention along a line IV—IV in FIG. 5, whereby a blade 12*a* is intended for the right-handed (the right hand behind, the concave side forward) and a blade 12*b* is intended for the left-handed (the left hand behind, the concave side forward).
Figure 5:
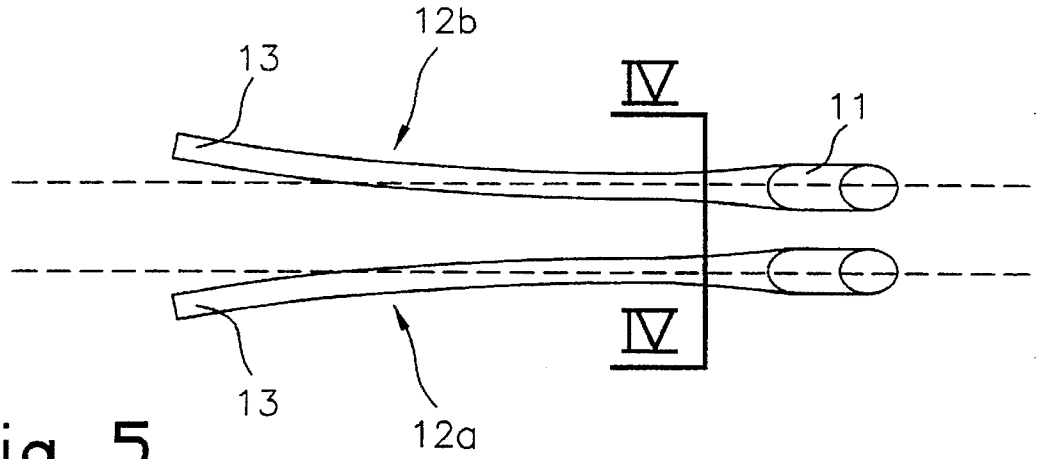
FIG. 5 shows the blades of FIG. 4 in a plan view.

The exemplary embodiment shown in FIGS. 4 and 5 only differs from what is described above in that just one side of the blade is concave and the other side is flat, whereby the concave surface may have a radius of curvature which is less than that in the embodiment of FIGS. 2 and 3. The blade designated by reference numeral 12*a* is intended for right-handed persons, whereby the right hand is on the back of the shaft and the concave blade surface is used for striking the ball. Respectively, the blade intended for left-handed persons is designated by reference numeral 12*b*, whereby the left hand is on the back surface of the shaft in view of hitting the ball with the concave side of the blade. In addition, the blade has a tip portion which curves towards the concave side. Depending on a particular embodiment, the blade side surface has a radius of curvature which is about 2–3 times more than the radius D/2 of a standard ball 3.

The embodiments of the invention in which an exclusive property or privilege is claimed as are follows:

1. A blade for an indoor bandy stick, comprising:

a top-edge reinforcing rib, a bottom-edge reinforcing rib, and a plurality of intermediate reinforcing ribs therebetween which run the length of the blade and are spaced from each other to define a plurality of open spaces therebetween, a centerline between two of said plurality of intermediated reinforcing ribs located at a distance from said bottom edge reinforcing rib generally equal to a radius of a bandy ball;

a plurality of cross ribs extending angularly to and bracing said reinforcing ribs;

said cross ribs remaining inside a contact surface defined by said reinforcing ribs above and below said centerline, whereby only horizontal reinforcing ribs on both sides of said centerline may contact the ball; and wherein one side of the blade is more concave than the opposite side.

2. A blade as set forth in claim 1, wherein the space between said reinforcing ribs is generally equal to about one-half of the radius (D/2) of the ball.

3. A blade as set forth in claim 1, wherein the blade has a height essentially equal to the diameter of the ball and said one side of the blade has a radius of curvature approximately two times greater than the radius of said ball.

4. A blade as set forth in claim 1, wherein a side of said reinforcement ribs on said opposite side is flat and an opposite side of said reinforcement ribs is concave.

5. A blade as set forth in claim 4, wherein said opposite side of the blade having the concave includes mid-section reinforcement ribs ribs having a lateral thickness which is approximately one-half the thickness of the top- and bottom-edge reinforcing ribs.

6. A blade as set forth in claim 1, wherein the blade has a tip portion which curves toward the concave side.

7. A blade for an indoor bandy stick, comprising:

a top-edge reinforcing rib, a bottom-edge reinforcing rib, and a plurality of intermediate reinforcing ribs spaced from each other to define spaces therebetween;

said reinforcing ribs braced by crosswise ribs disposed inside the contour of a contact surface defined by said reinforcing ribs both above and below a longitudinal centerline of the blade, wherein at least one of said plurality of intermediate reinforcing ribs contact the ball, and one side of the blade is more concave than the other side, the more concave side of the blade including a plurality of said reinforcing ribs having a lateral thickness approximately one-half the thickness of the top- and bottom-edge reinforcing ribs.

* * * * *

UNITED STATES PATENT AND TRADEMARK OFFICE

CERTIFICATE OF CORRECTION

PATENT NO. : 5,632,481

DATED : May 27, 1997

INVENTOR(S) : Michael Unger, et. al.

It is certified that error appears in the above-indentified patent and that said Letters Patent is hereby corrected as shown below:

Title page, item [30], Add: Foreign Application Priority Data: September 22, 1994[FI] Finland 944386--.

Column 1, line 2, insert--BACKGROUND OF THE INVENTION--.
Column 1, line 12, delete--BACKGROUND OF THE INVENTION--
Column 1, line 13, delete--pr and insert therefor--to--.
Column 1, line 58, before FIGURES insert -DRAWING--.
Column 2, line 45, blade 2 should be blade 12--.
Column 3, line 4, portion which should be portion 13 which--.
Column 4, line after concave should read--reinforcement ribs--. Col. 4, line 10, reinforcement ribs should be deleted--.

Signed and Sealed this

Eighteenth Day of November 1997

*Attest:*

Bruce Lehman

BRUCE LEHMAN

*Attesting Officer*

*Commissioner of Patents and Trademarks*